US008070413B2

(12) United States Patent
Brooks et al.

(10) Patent No.: US 8,070,413 B2
(45) Date of Patent: Dec. 6, 2011

(54) CONTROL SYSTEM FOR A LOAD HANDLING APPARATUS

(75) Inventors: Richard Anthony Brooks, Stoke-on-Trent (GB); Peter Jowett, Leicestershire (GB)

(73) Assignee: J. C. Bamford Excavators Limited, Uttoxeter, Staffordshire (GB)

( * ) Notice: Subject to any disclaimer, the term of this patent is extended or adjusted under 35 U.S.C. 154(b) by 1644 days.

(21) Appl. No.: 10/520,499

(22) PCT Filed: Jul. 2, 2003

(86) PCT No.: PCT/GB03/02857

§ 371 (c)(1),
(2), (4) Date: Jul. 18, 2005

(87) PCT Pub. No.: WO2004/007339

PCT Pub. Date: Jan. 22, 2004

(65) Prior Publication Data

US 2006/0103336 A1 May 18, 2006

(30) Foreign Application Priority Data

Jul. 12, 2002 (GB) ..... 0216204.8

(51) Int. Cl.
*B66C 1/00* (2006.01)

(52) U.S. Cl. ..... 414/699; 212/281; 212/278

(58) Field of Classification Search ..... 414/699, 414/685, 719, 718, 408; 212/281, 278; 60/468
See application file for complete search history.

(56) References Cited

U.S. PATENT DOCUMENTS

| | | | | |
|---|---|---|---|---|
| 4,042,135 | A * | 8/1977 | Pugh et al. | 414/718 |
| 4,319,864 | A * | 3/1982 | Kaufeldt | 414/751.1 |
| 4,822,237 | A * | 4/1989 | Meyer et al. | 414/708 |
| 5,058,752 | A * | 10/1991 | Wacht et al. | 212/278 |
| 5,257,177 | A * | 10/1993 | Bach et al. | 700/61 |

FOREIGN PATENT DOCUMENTS

| | | |
|---|---|---|
| FR | 2574389 | 7/1986 |
| FR | 2750972 | 1/1998 |
| GB | 1361832 | 7/1974 |
| GB | 1403046 | 8/1975 |
| GB | 1495675 | 12/1977 |
| GB | 1528741 | 10/1978 |
| GB | 2116518 | 9/1983 |
| JP | 5202535 | 8/1993 |
| JP | 2000104290 | 4/2000 |

* cited by examiner

*Primary Examiner* — Donald Underwood
(74) *Attorney, Agent, or Firm* — MacMillan, Sobanski & Todd, LLC

(57) ABSTRACT

A control system for a machine which includes a load handling apparatus for moving a load relative to a body of the machine. The machine includes a pivot about which a tipping moment is produced by the load. The load handling apparatus includes an actuator capable of moving the load to a position at which the tipping moment is at a threshold value. The control system is responsive to a tipping moment sensor to control operation of the actuator to progressively reduce the speed of movement of the load as the threshold value of the tipping moment is approached.

17 Claims, 2 Drawing Sheets

CONTROL SYSTEM FOR A LOAD HANDLING APPARATUS

CROSS-REFERENCE TO RELATED APPLICATIONS

This is a national phase application based on PCT application Serial No. PCT/GB2003/002857 filed Jul. 2, 2003. Priority is claimed to United Kingdom patent application Serial No. 0216204.8 filed Jul. 12, 2002.

This invention relates to a control system for a machine of the kind which includes a load handling apparatus, the load being moveable relative to a body of the machine by the load handling apparatus.

One example of such a machine is a wheeled load handling machine which has a body, a ground engaging structure including a pair of axles each carrying wheels, and the machine including a load handling apparatus which includes a lifting arm. The lifting arm is moveable by one or more actuators to move the load, the load producing a tipping moment about either an axis of rotation of one of the pairs of wheels, or about another pivot where for example, stabilisers are used to stabilise the body relative to the ground during load handling operations.

In each case, the lifting arm may move the load to a position at which the tipping moment is at a threshold value at which the machine may become unstable.

Thus it is known to sense the tipping moment, for example by sensing a decreasing load on the pair of wheels remote from the pivot, as the tipping moment reaches the threshold critical value, to operate a safety device which stops further operation of the actuator or actuators.

Such an arrangement may operate satisfactorily for some lifting arm/load movements, but unless the threshold value is set with a significant safety margin, for some load movements an abrupt cessation of movement can result in machine instability due to the inertia of the load, and of the lifting arm. The problem is particularly pronounced as the lifting arm is lowered after having been loaded at long reach and at height, as lowering of the lifting arm, increases the tipping moment and an abrupt cessation of movement can result in the machine tipping forwards.

It is known to provide a machine operator with a visual indication of the value of the tipping moment, and therefore a skilled and attentive operator may be able to determine when the tipping moment is approaching the threshold value and the operator may thus take action such as retracting the load, where the lifting arm is capable of such operation, to avoid machine instability. However this relies on operator skill and attentiveness, and moreover such reliance would be inappropriate where the machine does not have an operator, e.g. is robot or remote controlled.

According to a first aspect of the invention we provide a control system for a machine which includes a load handling apparatus, the load being moveable relative to a body of the machine by the load handling apparatus, the machine including a pivot about which a tipping moment is produced by the load, the load handling apparatus including an actuator and being capable of moving the load to a position at which the tipping moment is at a predetermined threshold value, the control system including a sensor to sense the tipping moment and in use, to provide an input to a controller, the controller being responsive to the input to influence operation of the actuator so that in the event that the sensor senses that the value of the tipping moment is approaching the threshold value, the speed of movement of the load is progressively reduced.

Thus utilising the present invention, stability of the machine during load movements which may otherwise cause instability, is automatically maintained and does not rely on operator skill.

In a preferred embodiment, the load handling apparatus is a lifting arm which is moveable about a generally horizontal axis relative to the body of the machine, the arm thus being capable of raising and lowering the load upon operation or a first actuator, the controller influencing operation of the first actuator as the tipping moment approaches the threshold value. The lifting arm may include a plurality of relatively moveable sections, which may for example be telescopic, and the controller may alternatively or additionally influence operation of a second actuator which relatively moves the arm sections as the tipping moment approaches the threshold value. Further, the arm may carry a load handling implement, such as lifting forks, which are movable on the arm by operation of a third actuator and the controller may additionally or alternatively influence operation of the third actuator as the tipping moment approaches the threshold value.

In each case, the speed of movement of the load is progressively reduced and desirably is stopped altogether when the tipping moment is at the threshold value, which preferably is set so that instability of the machine is avoided.

The machine may include a ground engaging structure by which the machine is supported on the ground. The structure may include a pair of supports, the tipping moment being produced about a pivot axis established by one of the supports. The tipping moment may be sensed by the sensor sensing loading of one of the supports.

In one example the machine is a so called wheeled load handling machine having a ground engaging structure including a pair of supports provided by axles which each carry wheels. Thus the tipping moment may be produced about a rotational axis of one of the pairs of wheels whilst the sensor may sense the loading on the other pair of wheels.

As the value of the tipping moment approaches the threshold value, the loading on the other pair of wheels will reduce which reduction in loading will be sensed by the sensor.

The actuator the operation of which is influenced, may be a fluid operated actuator such as a double acting linear hydraulic ram. The controller may influence operation of the actuator by reducing a flow of fluid to or from the actuator, regardless of any control input e.g. from a machine operator, so that the controller responds to the input from the sensor sensing the tipping moment by overriding any such control signal.

Thus the system may include a main control valve for providing fluid to the actuator under operator or robot/remote control, and a valve which is independent of the control valve, but responsive to the controller to reduce the flow of fluid to or from the actuator as the sensed tipping moment approaches the threshold value.

The sensor may be a transducer which provides an electrical input signal to the controller, whilst a control signal to influence actuator operation may be an electrical or fluid signal.

Where the load handling apparatus includes a plurality of actuators, for example where the load handing apparatus is a raisable and lowerable lifting arm which may be telescopic and/or may include a load handling implement mounted on the arm, each operated by respective fluid operated actuators, the controller may influence the operation of one of the actuators as the value of the tipping moment approaches the threshold value, for example by reducing the permitted flow of fluid from the actuator, and may prevent the flow of fluid to or from the remaining actuator or at least one of the remaining actuators if the tipping moment value reaches the threshold value, whilst permitting only further actuator correctional operation which will result in a reduction in the tipping moment.

However, for example where the load handling implement is a lifting forks, during any permitted correctional actuator operation, the attitude of the lifting forks relative to the ground may be maintained.

For example the machine may include a displacement actuator which is operated as the lifting arm is raised and lowered to exchange fluid with the third actuator which controls the attitude of the load handling implement relative to the ground, and during correctional actuator operation, when the third actuator may be isolated, fluid pressure in a circuit containing the third and displacement actuators may be maintained.

The controller may operate according to an algorithm which enables the controller to ignore transient changes of loading sensed by the sensor as a result of changing machine dynamics or of reaction to initial lift arm movements.

According to a second aspect of the invention we provide a machine having a control system according to the first aspect of the invention.

According to a third aspect of the invention we provide a load handling apparatus controlled by a control system according to the first aspect of the invention.

According to a fourth aspect of the invention we provide a method of operating a load handling system according to the third aspect of the invention including progressively reducing to speed of lowering of the load in response to increasing machine instability.

Embodiments of the invention will now be described with the aid of the accompanying drawings in which:—

Figures 1, 2:
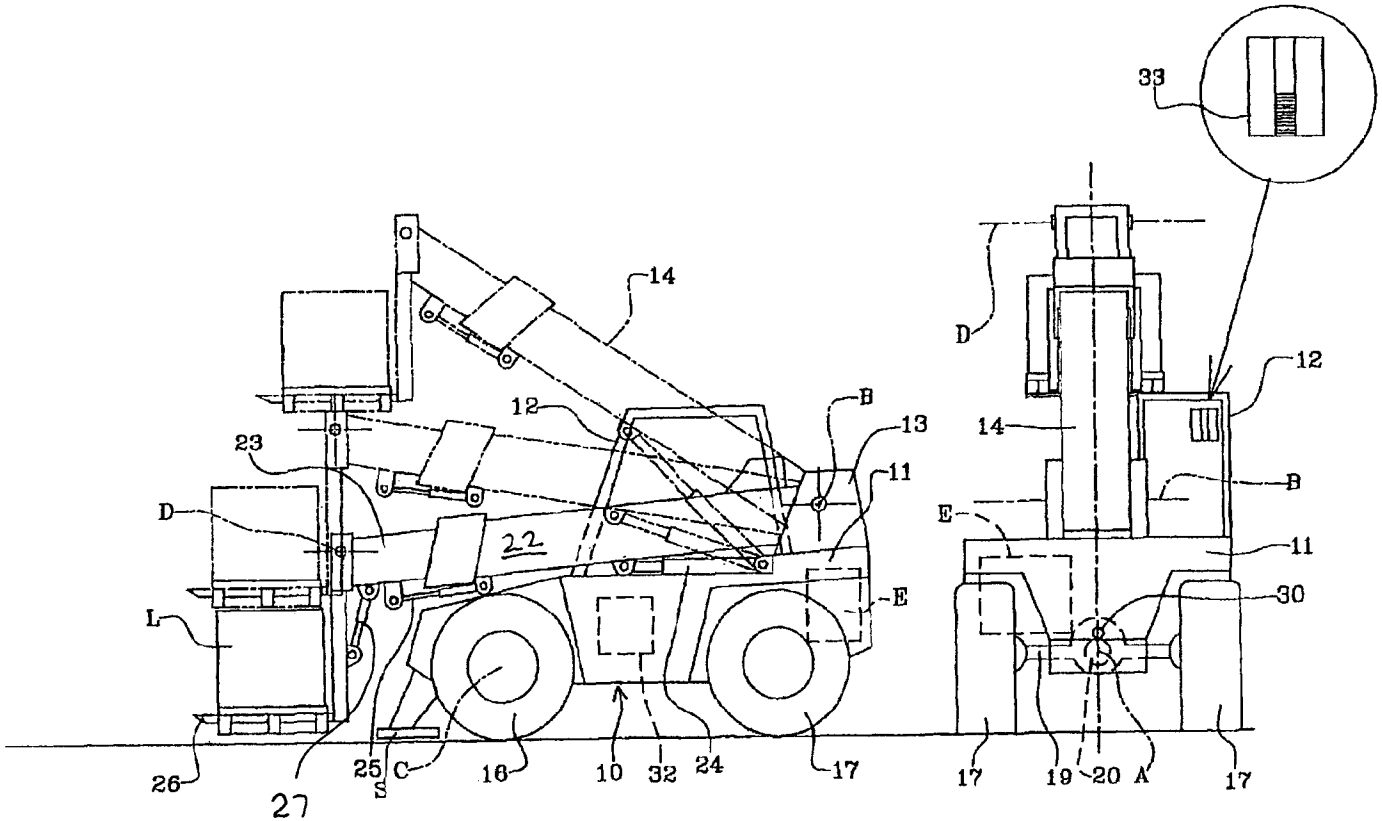
FIG. 1 is a side illustrative view of a machine embodying the invention.
FIG. 2 is a rear view of the machine shown in FIG. 1.

Referring to the drawings a load handling machine 10 includes a body 11 which includes in this example an operator's cab 12, at one side longitudinally of the body 12, and a mounting 13 for a lifting arm 14 at an opposite side of the body 12, the mounting 13 being provided in this example towards a rear of the body 12, such that the lifting arm 14 extends forwardly from a pivot axis B alongside the cab 12.

The body 12 is supported on and may be driven over the ground on a ground engaging structure which includes a pair of front wheels 16 carried on a front axle which usually is fixed relative to the body 12, but may be suspended therefrom as desired, and a rear pair of wheels 17 also carried on an axle 19, the rear axle 19 being in this example, coupled to the body 12 by a pivot 20 which permits oscillating rear axle 19 movement about a pivot axis A, relative to the body 12.

The lifting arm 14 in this example includes two relatively telescopic sections 22, 23, an inner of the sections 22 being mounted by the mounting 13, and the outer 23 of the sections carrying a load handling implement 26 which in this example is a pair of lifting forks. In another example the arm 14 may include more than two telescopic or otherwise relatively extendible sections, or a single section only.

The arm 14 is raisable and lowerable by operation of a lifting actuator 24, which is a double acting hydraulic linear actuator. The outer section 23 of the arm 14 may be extended/retracted relative to the inner section 22 by a further double acting hydraulic linear extension actuator 25 which is shown mounted exteriorly of the arm 14 although practically may be mounted interiorly of the arm 14. The load handling implement 26 is moveable about the pivot axis D by a yet further double acting linear hydraulic fork actuator 27.

Figure 3:
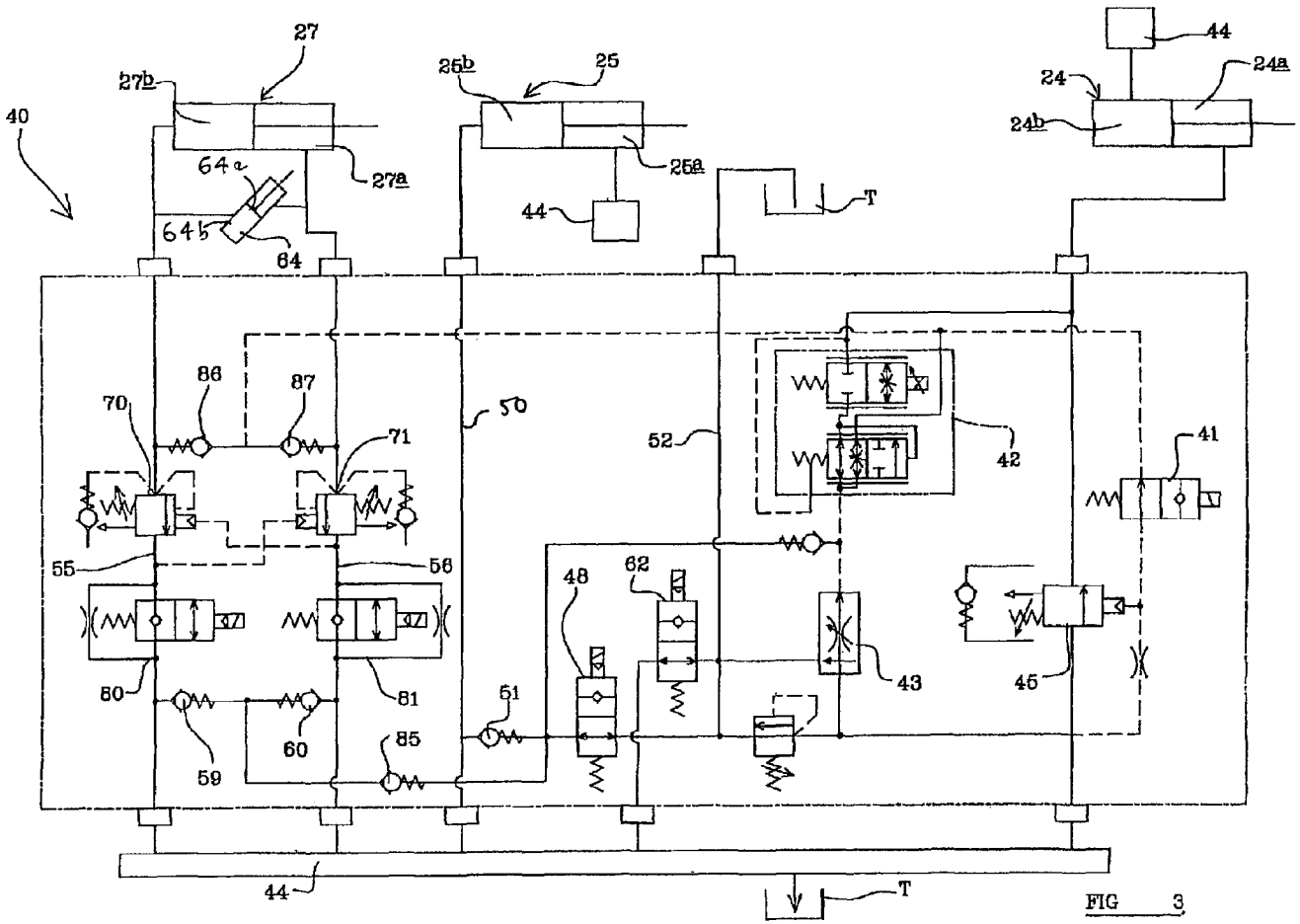
FIG. 3 is an illustrative hydraulic circuit diagram of the machine of FIGS. 1 and 2, which incorporates features of the control system of the invention.

The actuators 24, 25 and 27 are all controlled in this example by an operator in cab 12 operating controls to operate a main control valve 44, which is indicated in FIG. 3, but in another example the actuators may be remotely controlled by a computer i.e. may be robot controlled.

It will be appreciated that a load L carried by the arm 14 will produce a tipping moment about a pivot axis C. In this example of a wheeled load handling machine 10 with the lifting arm 14 being rearwardly mounted and extending forwardly, the pivot C will be coincident with the axis of rotation of the front wheels 16. However, where for example stabilisers 32 are provided which can be lowered into contact with the ground during some load handling operations, perhaps to raise the front wheels 16 off the ground, the pivot axis may otherwise be located.

Even though the weight of the load L is counterbalanced by the mass of the machine 10 and in particular in this example by the machine engine E which may be positioned at the rear of the body 12 as indicated, or elsewhere, if the load L is moved forwardly of the tipping axis C beyond a certain position, dependant upon the magnitude of the load, it will be appreciated that the stability of the machine 10 will decrease as the machine 10 will tend to tip about the tipping axis C. Such load L movement may occur for example as the lifting arm 14 is extended, or as is pertinent to the present invention, upon lowering of a load L from a high position, e.g. as indicated in dotted lines to a lowered position shown in dotted lines.

The resultant increase in the tipping moment about tipping axis C is conventionally determined by sensing a reduction in loading on the rear axle 19 on which the body 12 is supported.

Thus a tipping moment sensor 30 is provided, such as a load cell or other transducer to sense the loading on the axle 19, in this example at the pivot 20 connection of the rear axle 19 to the body 12. The sensor 30 is operative to provide an input to a controller 32 indicative of rear axle 19 loading and thus of the tipping moment about the tipping axis C.

In known arrangements, when the input to the controller 32 indicates that the tipping moment is about to increase to such an extent that the machine 10 is about to tip forwardly about the tipping axis C, the controller 32 acts to prevent further forward movement of the load L relative to the body 12. For example the extension actuator 25 may be prevented from extending further and/or the lifting actuator 24 may be prevented from further lowering the lifting arm 14.

In the latter case, because the inertia of a loaded lifting arm and load L may be massive, an abrupt cessation of the downward movement of the arm 14 can result in the machine 10 tipping about the tipping axis C unless the threshold value of the tipping moment permitted is set to an impracticably acceptable safety limit.

Referring particularly to FIG. 3, a control system 40 is shown partially integrated within a hydraulic system for operating and controlling the actuators 24, 25, 27.

When the control system 40 is actuated, for example in anticipation of handling a heavy load, a solenoid valve 41 is closed e.g. by a machine 10 operator operating a switch in the cab 12, so that fluid to a rod side 24*a* of the lifting actuator 24 from main control valve 44 as the lifting arm 14 is lowered, is constrained to flow through a proportional valve 42, via a restrictor 43. The restrictor 43 reduces permitted flow from that which would be permitted when the control system 40 is not active. Thus the lowering speed of the lifting arm 14 will be constrained in any event.

However the flow of fluid to the rod side 24*a* of the lifting actuator 24 may be further restricted by the proportional valve 42 as hereinafter explained, to maintain the value of the tipping moment of the machine about axis C below a threshold value.

In parallel with the proportional valve 42 there is a counterbalance valve 45 which permits fluid from the main control valve 44 to be directed to the rod side 24*a* of the actuator 24 when it is desired to lower the lifting arm 14 when the control system of the invention is inactive.

In the event that from the input from the sensor 30, the controller 32 determines that the value of the tipping moment about pivot C is approaching a predetermined threshold value, for example is about 65% of the permitted tipping moment threshold value, the controller 32 acts to prevent the value of the tipping moment exceeding the threshold value.

If the lifting arm 14 is being lowered, the controller 32 signals the proportional valve 42 to reduce the permitted flow of fluid to the rod side 24*a* of the actuator 24 progressively as the lifting arm 14 is continued to be lowered, until further lowering of the lifting arm 14 is prevented altogether when the value of the tipping moment reaches the threshold value, as all fluid flow to the rod side 24*a* of the actuator 24 is prevented by the proportional valve 42 closing completely or substantially completely.

It can be seen that the proportional valve 42 is in this example solenoid operated, so that the controller 32 provides an electrical command signal to the proportional valve 42 although in another example a fluid pressure signal may be provided by the controller 32.

The machine operator in the cab 12 may reverse operation of the lifting actuator 24 by operating the main valve 44 to direct fluid to a cylinder side 24*b* of the actuator 24 to raise the lifting arm 14 and thus reduce the tipping moment about axis C, and/or may retract the extension actuator 25 to move the load L closer to the tipping axis C, by operating the main control valve 44 to direct fluid to a rod side 25*a* of the extension actuator 25.

Upon the threshold tipping value being reached, when further lowering of the lifting arm 14 will be prevented, the controller 32 also acts to open a further solenoid operated valve 48 in the circuit to prevent any operation of the extension actuator 25 which would move the load L further away from the tipping axis, and to isolate altogether the actuator 27 which is otherwise operative to move the lifting forks 26.

This is achieved as the further solenoid operated valve 48 when opened provides a by-pass to tank T. Thus in the event that the main control valve 44 is operated such as would otherwise extend the lifting arm 14, fluid in line 50 which would otherwise pass to cylinder side 25*b* of the extension actuator 25 to extend the extension actuator 25, will be relieved to tank T, via a non return valve 51 and the valve 48, via line 52.

Moreover in the event that the operator operates the main valve 44 such as otherwise to operate the actuator 27 to move the lifting forks 26 about axis D on the arm 14, again fluid in either of lines 55, 56 which would otherwise act to operate the actuator 27, will be relieved to tank T, via one or other of the non-return valves indicated at 59, 60 and the valve 48, via line 52.

If desired, where the machine 10 has stabilisers S which may be lowered into engagement with the ground during some working operations, a relief valve as indicated at 62 may be provided which restricts the angle to which the lifting arm 14 may be raised when the stabilisers S are not lowered. For example, when the machine 10 is performing working operations with the stabilisers S raised, such that there is greater potential for machine 10 instability, when the arm 14 is raised at an angle of 45°, the relief valve 62 may be opened e.g. by operation of the controller 32, so that further fluid directed from the main control valve 44 to the rod side 24*a* of the lifting actuator 24 is relieved to tank T.

Referring again to FIG. 1 it can be seen that the machine 10 includes a displacement actuator 64 between the lifting arm 14 and the body 12 of the machine. The displacement actuator 64 is a double acting hydraulic actuator, a piston 64*a* of the actuator 64 being extended relative to a cylinder 64*b* thereof, as the lifting arm 14 is raised, and being retracted into the cylinder 64*b* as the arm 14 is lowered.

As indicated in FIG. 3, in normal operation, the displacement actuator 64 is provided in parallel to the actuator 27 which moves the lifting forks 26 about the axis D, and so as the arm 14 is raised and lowered, the attitude of the forks 26 or other load handling device 26 relative to the ground, may be maintained without intervention of the operator operating the main control valve 44 to operate the forks actuator 27.

Such an arrangement is known, but it will be appreciated that in the event that, with the control system of the invention, the relief valve 48 is opened to relieve fluid in that part of the circuit containing the fork actuator 27, such automatic attitude maintenance will be lost. So in the event that the operator operates the lifting actuator 24 to correct machine 10 imbalance by raising the lift arm 14, until the relief valve 48 again is closed by the controller 32, the attitude of the forks 26 relative to the ground will not be maintained.

However, to accommodate this, there is provided in each of the fluid lines 55 and 56 from the fork actuator 27 and displacement actuator 64, a counterbalance valve 70, 71 respectively, which closes automatically upon loss of pressure in the lines 55, 56 as the relief valve 48 is opened, whilst permitting the transfer of fluid between the fork actuator 27 and the displacement ram 64 trapped in that part of the fluid circuit upstream of the counterbalance valves 70, 71.

Other features of the control circuit 40 are as follows.

In the lines 55, 56 to and from the fork actuator 27 and displacement actuator 64, there are provided solenoid operated restrictor valves 80, 81 which when operated e.g. by the controller 32 when the control system is actuated, may restrict operational speed of the fork actuator 27, by restricting fluid flow to and from the actuators 27, 64 in proportion to the degree of instability of the machine 10 as sensed by the load sensor 30.

Other check valves and the like, e.g. as indicated at 85, 86 and 87 may be provided to ensure proper operation of the circuit.

It has been found that in some conditions, when commencing lowering of the load L e.g. from a high position, there is an initial reaction which is transmitted through the machine 10 to the load sensor 30 which indicates a sudden increase in loading on the rear axle 19. To prevent the control system reacting to such transient conditions, preferably the controller 32 is adapted to operate according to an algorithm which ignores such transient conditions. For example upon initiating lowering of the lifting arm 14, the controller 32 may be arranged not to respond to the sensor 30 input for say, one or two seconds, by which time steady state conditions will ensue.

Also, it will be appreciated that a false indication may be received from the sensor 30 of impending machine 10 instability as a result of changing machine 10 dynamics during some load handling operations, for example during loading/unloading of the lifting forks 26. The controller 32 may be programmed to recognise such irregular indications, for example by responding only to a smoothly progressively changing tipping moment, rather than sudden changes in loading.

Preferably, the controller 32 provides a visual indication on an indicator 33 in the operator's cab 12 to the operator of the stability of the machine 10 so that a skilled operator may still exercise his skill in avoiding unstable conditions with reference to the indicator 33. For example such an indicator may include an array of lights, e.g. LED lights, the array being increasingly lit up as instability of the machine 10 increases.

Various other modifications may be made without departing from the scope of the invention as will be apparent to the person skilled in the art.

The features disclosed in the foregoing description, or the following claims, or the accompanying drawings, expressed in their specific forms or in terms of a means for performing the disclosed function, or a method or process for attaining the disclosed result, as appropriate, may, separately, or in any combination of such features, be utilised for realising the invention in diverse forms thereof.

The invention claimed is:

1. A control system for a machine which includes a load handling apparatus, the load being moveable relative to a body of the machine by the load handling apparatus, the load handling apparatus being a lifting arm which is moveable about a generally horizontal axis relative to the body of the machine, the arm thus being capable of raising and lowering the load upon operation of a fluid operated actuator the machine including a pivot about which a tipping moment is produced by the load, the load handling apparatus being capable of lowering the load to a position at which the tipping moment is at a predetermined threshold value, the control system including a sensor to sense when the value of the tipping moment is approaching the threshold value and, to provide an input to a controller in response, the controller being responsive to the input to operate a proportional valve to reduce the flow of fluid to the actuator so that the speed of movement of the load is progressively reduced as the lifting arm is continued to be lowered.

2. A system according to claim 1 wherein the lifting arm includes a plurality of relatively moveable sections, and the controller influences operation of a second actuator which relatively moves the arm sections as the tipping moment approaches the threshold value.

3. A system according to claim 2 wherein the relatively moveable sections are telescopic.

4. A system according to claim 1 wherein the arm carries a load handling implement which is movable on the arm by operation of a third actuator and the controller influences operation of the third actuator as the tipping moment approaches the threshold value.

5. A system according to claim 4 wherein the load handling implement is a loading forks.

6. A system according to claim 1 wherein the speed of movement of the load is progressively reduced and is stopped altogether when the tipping moment is at the threshold value.

7. A system according to claim 1 wherein the machine includes a ground engaging structure by which the machine is supported on the ground the ground engaging structure including a pair of supports, the tipping moment being produced about a pivot axis established by one of the supports, the tipping moment being sensed by the sensor sensing loading of one of the supports.

8. A system according to claim 7 wherein the machine is a wheeled load handling machine having a ground engaging structure including a pair of supports provided by axles which each carry wheels.

9. A system according to claim 8 wherein the tipping moment is produced about a rotational axis of one of the pairs of wheels and the sensor senses the loading on the other pair of wheels.

10. A system according to claim 1 wherein the fluid operated actuator is a double acting linear hydraulic ram.

11. A system according to claim 1 wherein the sensor is a transducer which provides an electrical input signal to the controller.

12. A system according to claim 6 wherein the load handling apparatus includes a plurality of actuators, and in the event that the controller prevents the flow of fluid to or from the raising and lowering actuator if the tipping moment value reaches the threshold value, the controller permits one or more of the further actuators to be operated to perform a correctional operation which will result in a reduction in the tipping moment.

13. A system according to claim 12 wherein where the load handling implement is a lifting forks, and during any permitted correctional actuator operation, the attitude of the lifting forks relative to the ground is automatically maintained.

14. A system according to claim 13 wherein the machine includes a displacement actuator which is operated as the lifting arm is raised and lowered to exchange fluid with an actuator which controls the attitude of the load handling implement relative to the ground, and during correctional actuator operation, when the raising and lowering actuator is isolated, fluid pressure in a circuit containing the attitude controlling and displacement actuators is maintained.

15. A system according to claim 1 wherein the controller operates according to an algorithm which enables the controller to ignore transient changes of loading sensed by the sensor as a result of changing machine dynamics or of reaction to initial lift arm movements.

16. A machine having a control system which includes a load handling apparatus, the load being moveable relative to a body of the machine by the load handling apparatus, the load handling apparatus being a lifting arm which is moveable about a generally horizontal axis relative to the body of the machine, the arm thus being capable of raising and lowering the load upon operation of a fluid operated actuator the machine including a pivot about which a tipping moment is produced by the load, the load handling apparatus being capable of lowering the load to a position at which the tipping moment is at a predetermined threshold value, the control system including a sensor to sense when the value of the tipping moment is approaching the threshold value and, to provide an input to a controller in response, the controller being responsive to the input to operate a proportional valve to reduce the flow of fluid to the actuator so that the speed of movement of the load is progressively reduced as the lifting arm is continued to be lowered.

17. A load handling apparatus controlled by a control system which includes a load handling apparatus, the load being moveable relative to a body of the machine by the load handling apparatus, the load handling apparatus being a lifting arm which is moveable about a generally horizontal axis relative to the body of the machine, the arm thus being capable of raising and lowering the load upon operation of a fluid operated actuator the machine including a pivot about which a tipping moment is produced by the load, the load handling apparatus being capable of lowering the load to a position at which the tipping moment is at a predetermined threshold value, the control system including a sensor to sense when the value of the tipping moment is approaching the threshold value and, to provide an input to a controller in response, the controller being responsive to the input to operate a proportional valve to reduce the flow of fluid to the actuator so that the speed of movement of the load is progressively reduced as the lifting arm is continued to be lowered.

* * * * *